US005362020A

United States Patent [19]

Brown

[11] Patent Number: 5,362,020

[45] Date of Patent: Nov. 8, 1994

[54] SUPPORT STRUCTURE FOR ROAD SIGNS

[75] Inventor: Francis C. Brown, Mangalore, Australia

[73] Assignee: Doyle & Brown Pipelines Pty. Ltd., Malvern, Australia

[21] Appl. No.: 39,343

[22] PCT Filed: Oct. 15, 1991

[86] PCT No.: PCT/AU91/00478

§ 371 Date: Jun. 7, 1993

§ 102(e) Date: Jun. 7, 1993

[87] PCT Pub. No.: WO92/07143

PCT Pub. Date: Apr. 30, 1992

[51] Int. Cl.[5] ..... G09F 15/00

[52] U.S. Cl. ..... 248/166; 40/606; 40/611; 40/612; 182/155; 182/186; 248/176

[58] Field of Search ..... 248/166, 168, 176, 177, 248/188.1; 40/606, 610, 611, 612; 182/155, 186

[56] References Cited

U.S. PATENT DOCUMENTS

| | | | |
|---|---|---|---|
| Re. 32,359 | 2/1987 | Seely | 40/606 X |
| 1,674,716 | 6/1928 | Craft | 40/606 |
| 2,863,238 | 12/1958 | Keech | 40/606 |
| 4,726,132 | 2/1988 | Ernest | 40/606 X |
| 4,967,877 | 11/1990 | Wallman et al. | 182/155 |
| 5,028,031 | 7/1991 | Stoudt | 40/612 X |
| 5,040,321 | 8/1991 | Stoudt | 40/612 X |
| 5,079,861 | 1/1992 | Stoudt | 40/612 X |
| 5,095,642 | 3/1992 | George et al. | 40/606 |

FOREIGN PATENT DOCUMENTS

| | | | |
|---|---|---|---|
| 2460017 | 2/1981 | France | 40/612 |
| 2240207 | 7/1991 | United Kingdom | 40/606 |

*Primary Examiner*—Alvin C. Chin-Shue
*Assistant Examiner*—Derek J. Berger
*Attorney, Agent, or Firm*—Walter C. Farley

[57] ABSTRACT

A support structure for a road warning sign comprising a pair of elongated hinged crossbar members having support leg members pivotally connected thereto at their ends, said support leg members being adapted to be swung outwardly and downwardly from a folded location along the crossbar members to a ground engaging position whereby said hingedly connected crossbar members close to secure therebetween a sheet material road sign.

13 Claims, 5 Drawing Sheets

SUPPORT STRUCTURE FOR ROAD SIGNS

FIELD OF THE INVENTION

THIS INVENTION relates to a support structure for road warning signs such as "WORKMEN AHEAD" signs and the like.

BACKGROUND OF THE INVENTION

Conventional signs of this type at present in use are fixedly mounted on relatively small diameter spindly metal legs, have an inherent high centre of gravity and as such are susceptible to being blown over by the wind or by the suction induced by passing vehicles.

Furthermore as these known supports and signs are permanently fixed together it has been necessary in the past to provide the combination of support and sign for each different sign.

It is an object of the present invention to provide a support structure for a road warning sign which has a configuration providing a relatively low centre of gravity, is not susceptible to being blown over and which can singly mount any desired sign in a simple yet effective releasable locking manner thereby greatly reducing the cost of a multiplicity of support structures with various fixed signs and greatly reducing the transporting space required by road working gangs.

It is a further object of the present invention to provide a support structure for a road warning sign which may be folded into a compact configuration when not in use to minimum packaging and handling requirements.

SUMMARY OF THE INVENTION

According to the invention, there is provided a support structure for a road warning sign comprising a pair of elongated crossbar members hingedly connected on the underside thereof, socket members secured adjacent each end of said crossbar members, support leg members pivotally mounted in said socket members so as to extend downwards and outwards of and substantially normal to the plane of said crossbar members in a ground engaging position and foldable along said crossbar members in a demountable position whereby when said leg members are swung outwardly to a ground engaging position said hingedly connected crossbar members close to secure therebetween a sheet material road sign.

According to a further feature of the invention the legs of a pair of leg members pivotally mounted at one end of the crossbar members are offset along part of their length so as to nest in compact form with the other pair of leg members when folded to the demountable position.

According to another feature of the invention, a pair of leg members pivotally mounted at each end of the crossbar members are pivotally mounted in their socket members at a distance from the crossbar members greater than the distance of the pivotal mounting of the other pair of leg members so as to nest against said other pair of leg members in compact form when the structure is folded to the demountable position.

In order that the invention and its manner of performance may be more fully understood reference will now be made to embodiments of the invention as illustrated in the accompanying drawings.

DESCRIPTION OF THE PREFERRED EMBODIMENTS

Referring to FIG. 1 to 5 of the drawings the road sign support structure of this illustrated embodiment comprises a pair of elongated angular crossbar members 5 hingedly connected at 6 and comprising substantially horizontal extending bar members 7 having outwardly extending angled members 8 at the upper ends thereof.

Sockets 9 are attached, as by welding, at the ends of the crossbar members 5 between the bar members 7 and the angle members 8 which form locating jaws for a road sign. Sockets 9 are of U-shaped configuration, closed on the outer sides thereof at 10 and open on their inwardly facing sides at 11.

Figure 1:
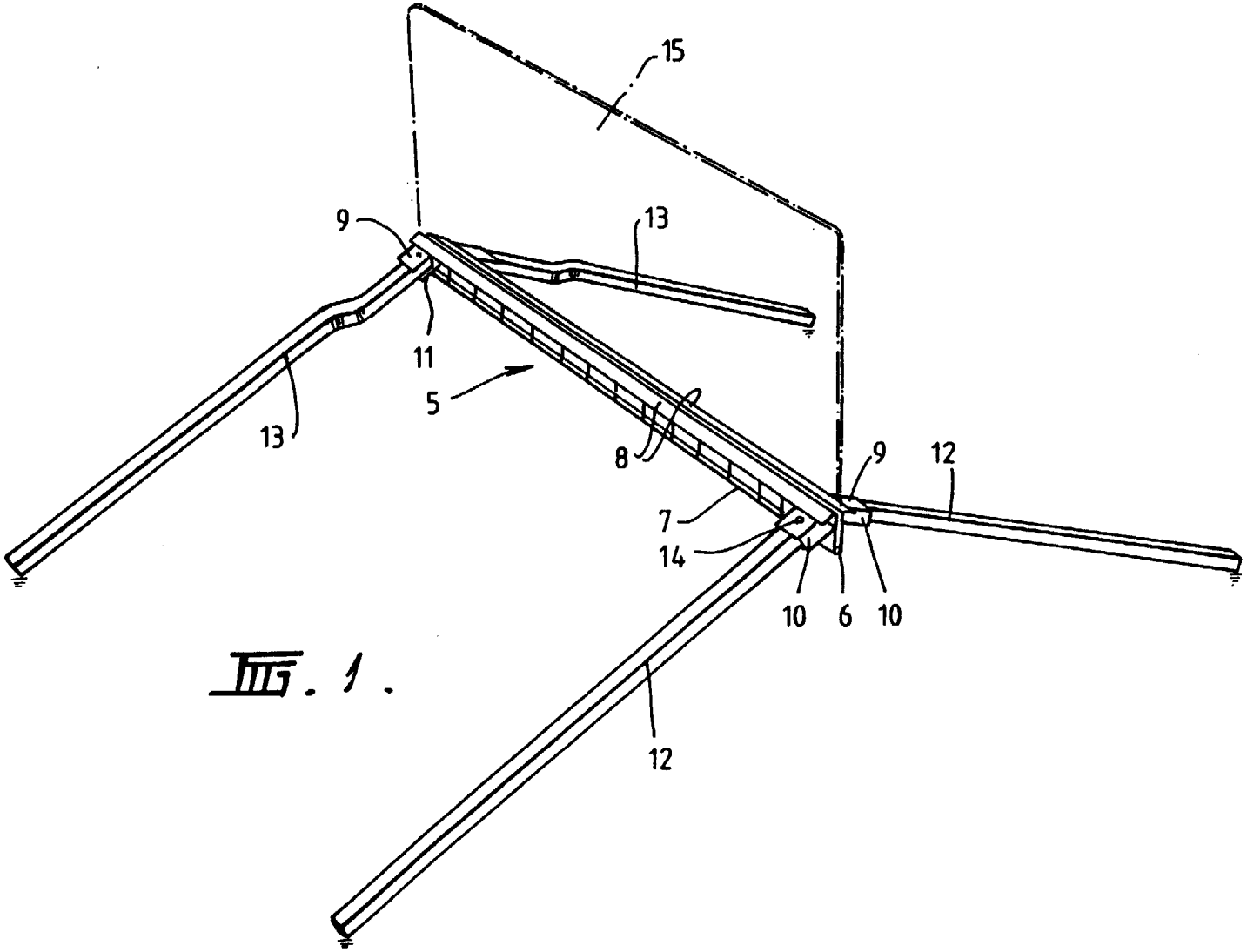
FIG. 1 is a perspective view of one embodiment of the support structure with a road sign located thereon.
Figure 2:
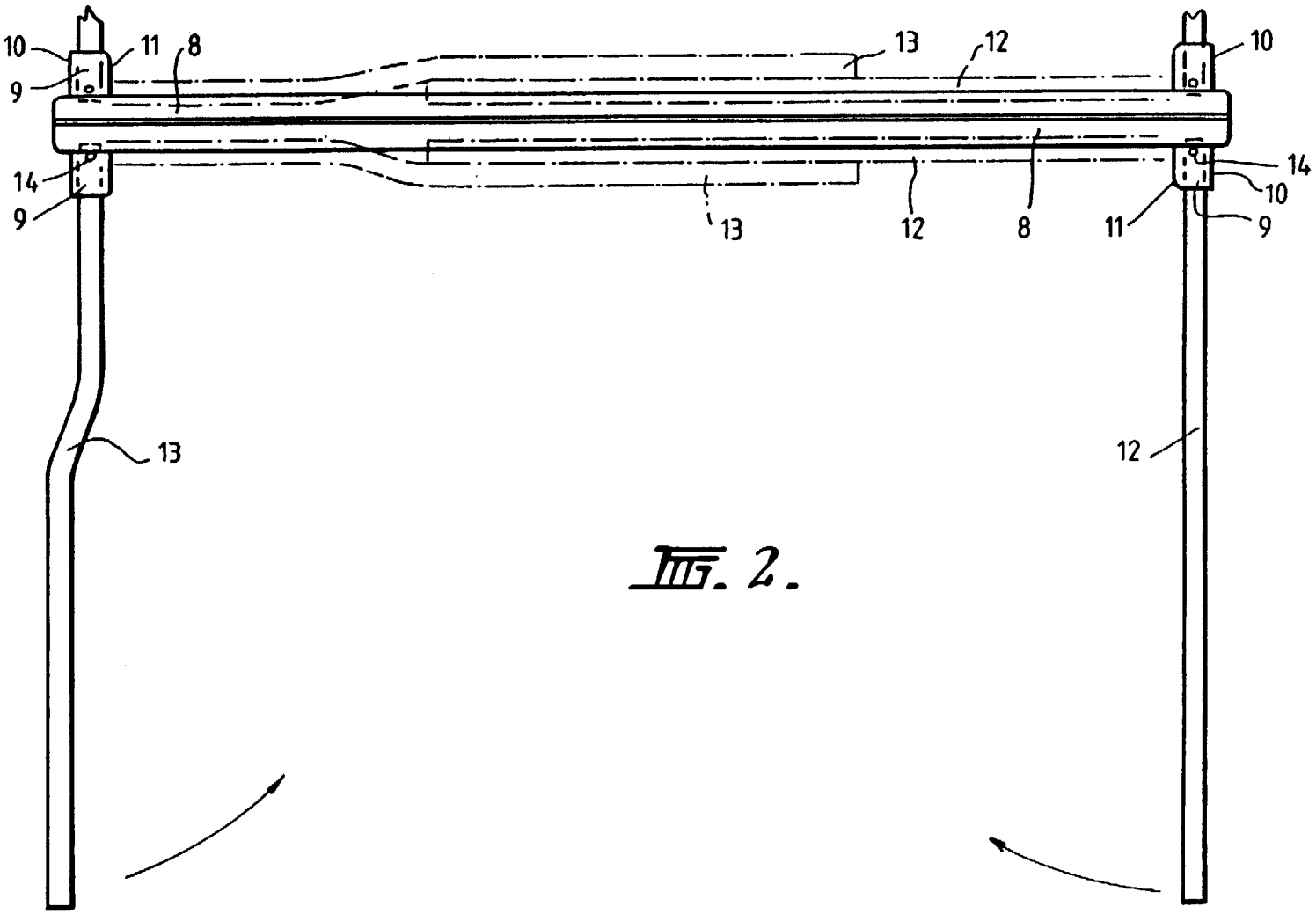
FIG. 2 is a plan view of the support structure of FIG. 1 showing the leg members on one side in extended ground engaging position and both sets of leg members in demountable folded position in broken line.
Figure 3:
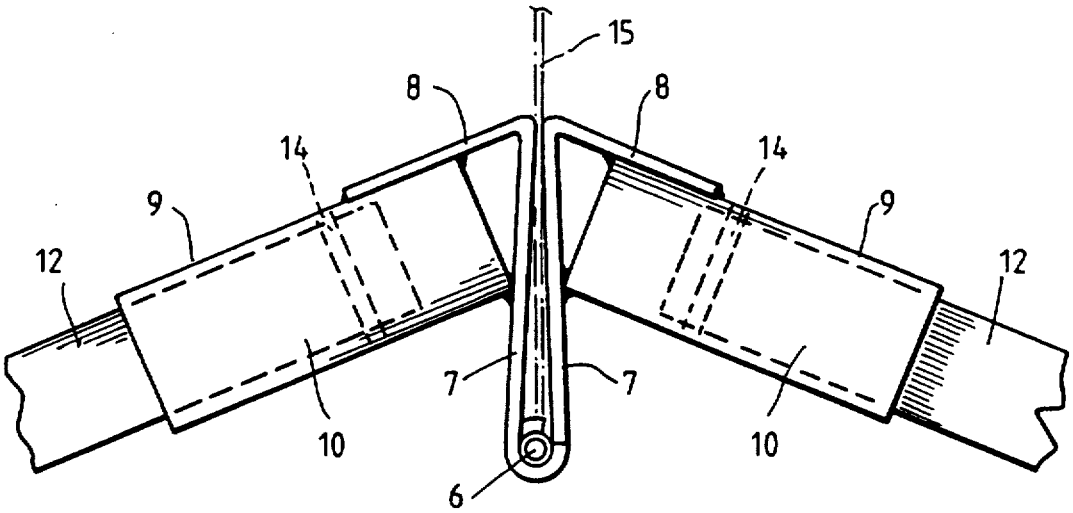
FIG. 3 is an end view of the support structure of FIG. 1 showing the mounting of the support leg members.
Figure 4:
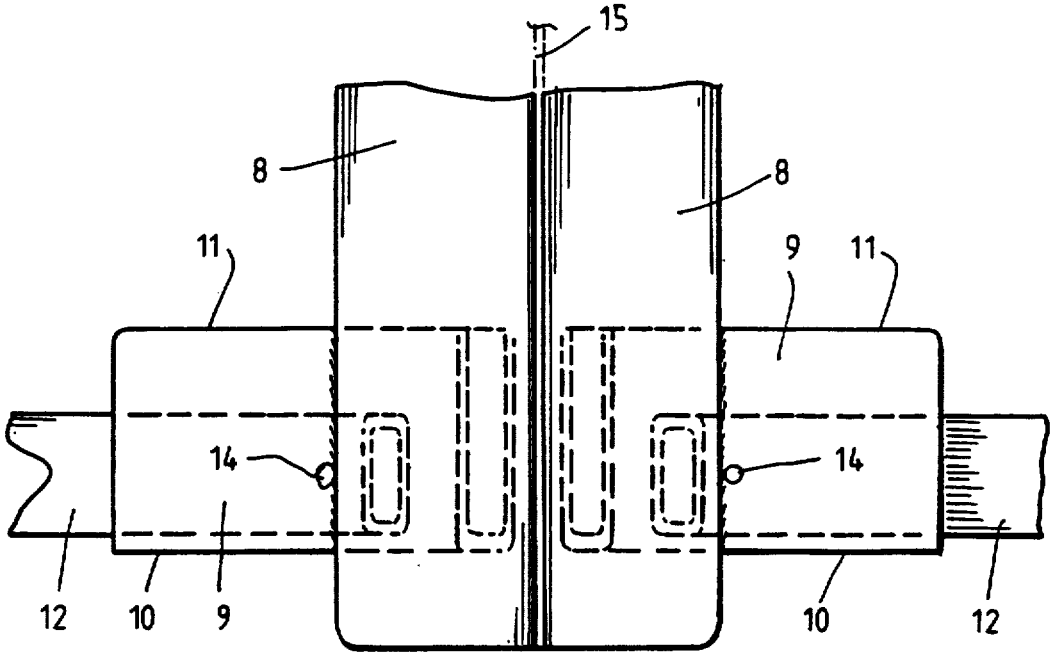
FIG. 4 is a plan view of an end of the support structure of FIG. 1.

Support legs 12 and 13 are pivotally mounted in sockets 9 on pins 14 so as to be movable inwards along crossbar members 5 to a folded demountable nesting configuration of the support structure into a compact minimum package for transporting purposes as shown in broken line in the upper part of FIG. 2.

In use, the support structure with the leg members 12 and 13 extending outwardly and downwardly therefrom is positioned on the ground so as to provide a clearance between bar members 7 at their upper ends to allow insertion of a road sign plate or the like 15 therebetween whereby on further outward movement of leg members 12 and 13, the road sign is securely and effectively gripped between members 7 with the weight of the support structure and the outwardly splayed angle of the support legs firmly locking the road sign in the structure with a leverage effect.

The two support leg members 13 have an offset configuration to allow them to be hinged inwardly over leg members 12 when the road sign is removed and the support structure is collapsed into a compact packaged form.

Figure 5:
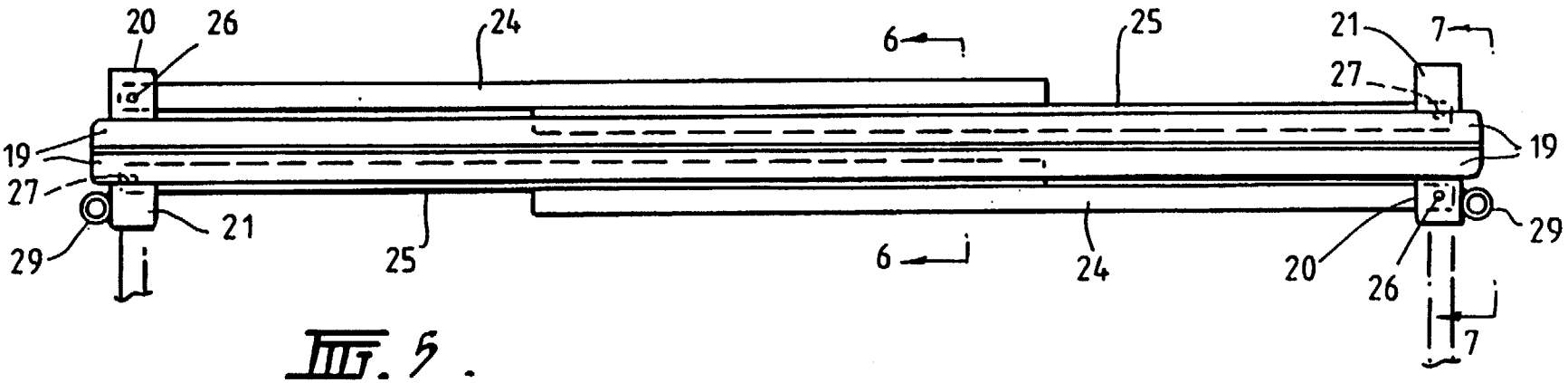
FIG. 5 is a view similar to FIG. 2 of another embodiment of the invention.
Figure 6:
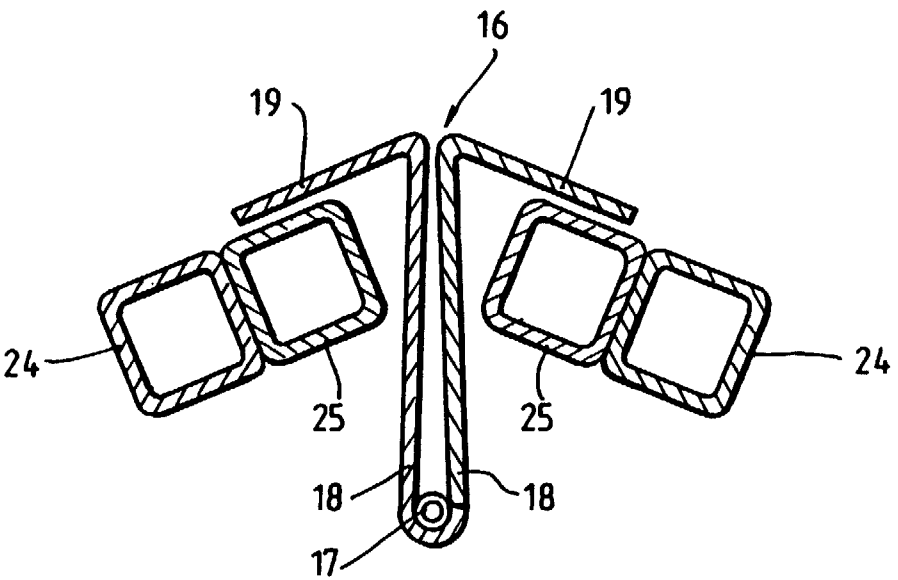
FIG. 6 is a sectional end view taken along the line 6—6 of FIG. 5.
Figure 7:
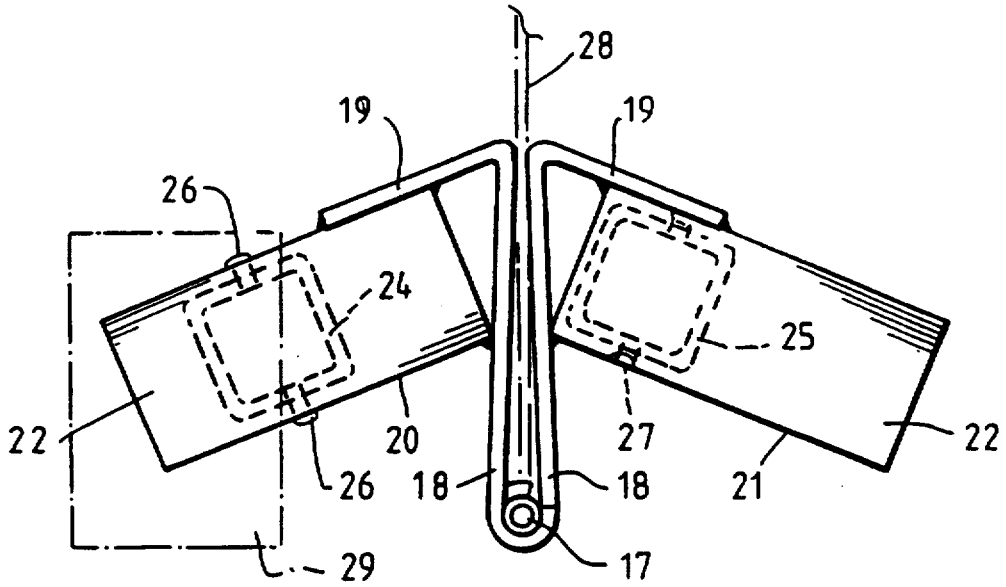
FIG. 7 is an end view taken along the line 7—7 of FIG. 5.
Figure 8:
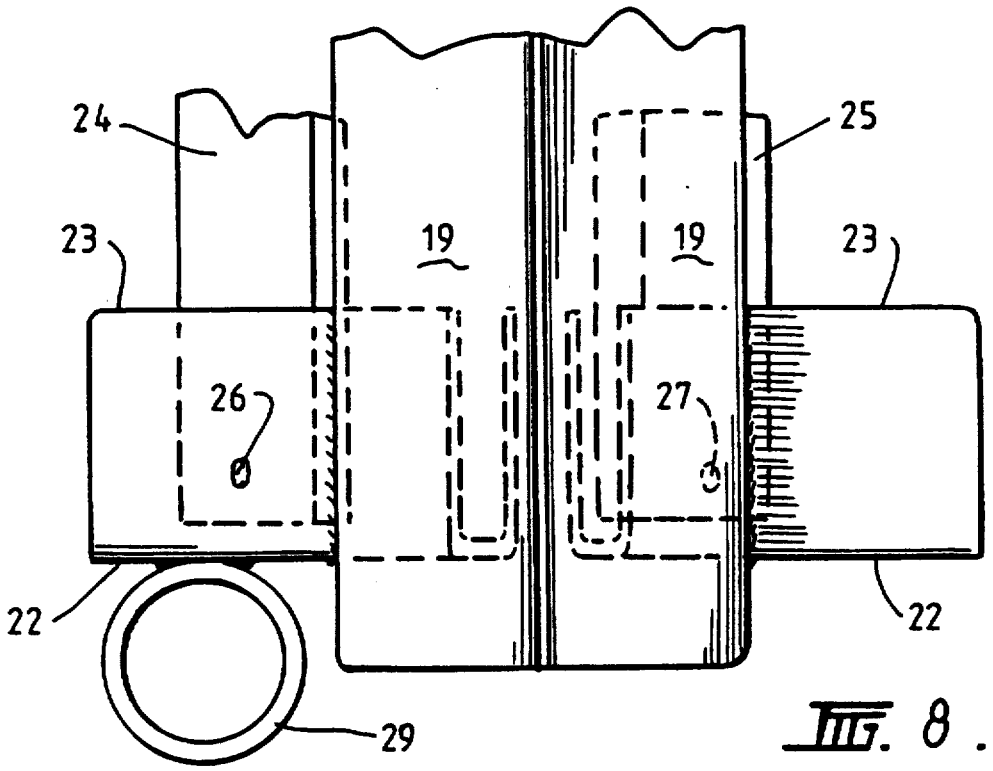
FIG. 8 is a plan view of the end of the support structure illustrated in FIG. 7.

Referring to FIGS. 6 to 8 of the drawings, the road sign structure of this illustrated embodiment is basically similar in function to the embodiment of FIGS. 1 to 5 and comprises a pair of elongated angular crossbar members 16 hingedly connected at 17 and comprising substantially horizontally extending bar members 18 having outwardly angled members 19 at the upper ends thereof.

Sockets 20 and 21 are attached, as by welding, at the ends of the crossbar members 16 between the bar members 18 and the angle members 19 which form locating jaws for a road sign. Sockets 20 and 21 are of a U-shaped configuration, closed on the outer side thereof at 22 and open on their inwardly facing sides at 23.

Two pairs of support legs 24 and 25 are pivotally mounted in sockets 20 and 21 on pins 26 and 27 so as to be movable inwards along crossbar members 16 to a folded demountable nesting configuration of the support structure into a compact minimum package for transporting purposes as shown in FIG. 5.

In use, the support structure with the leg members 24 and 25 pivoted outwardly and downwardly therefrom is positioned on the ground so as to provide a clearance between bar members 18 at their upper ends to allow insertion of a road road plate or the like 28 therebetween whereby on further outward movement of leg members 24 and 25, the road sign is effectively gripped between bar members 18 with the weight of the support structure and the outwardly splayed angle of the support legs firmly locking the road sign in the structure with a leverage effect.

The pivot pins 26 of support legs 24 are located in sockets 20 at a distance from their bar member 18 greater than the distance of pivot pins 27 of support legs 25 from their bar member 18 so as to allow support legs 24 to be pivoted inwardly over support legs 25 when the road sign is removed and the support structure is collapsed into a compact packaged form.

Tubular holders 29 may be provided at the ends of the support structure for locating the poles or sticks of conventional warning flags or the like. Holders 29 may also be incorporated in the structure of FIGS. 1 to 4.

It will be appreciated that various types of road sign sheets or plates can be used in the support structure of the invention, the signs being replaced with a minimum of effort.

The structure of the invention may be conveniently constructed in metal or a suitable plastics material.

I claim:

1. A support structure for a road warning sign comprising a pair of elongated crossbar members hingedly connected on their undersides for locating a sheet material road sign therebetween, socket members secured adjacent each end of each of said crossbar members, support legs pivotally mounted in said socket members so as to extend downwardly and outwardly of and substantially normal to the plane of said crossbar members in a ground engaging position and foldable along said crossbar members in a demountable position whereby, when said leg members are swung outwardly to said ground engaging position, said hingedly connected crossbar members close, under the weight of the support structure and the leverage effect of the outwardly extending ground engaging legs, to secure between said crossbar members a lower edge of a sheet material road sign.

2. A support structure according to claim 1 wherein the legs of a pair of leg members pivotally mounted at one end of the crossbar members are offset along part of their length so as to nest in compact form with the other pair of leg members when folded to the demountable position.

3. A support structure according to claim 1 wherein one of a pair of said leg members pivotally mounted at each end of each said crossbar member is pivotally mounted in its socket member at a distance from said crossbar member greater than the distance from the crossbar members of the pivotal mounting of the other of said pair of leg members so as to nest against said other leg against said crossbar member in compact form when the structure is folded to the demountable position.

4. A support structure according to claim 3 wherein said socket members are of U-shaped configuration, closed on their sides facing outwardly from the ends of said crossbar members and open on their sides facing inwardly from the ends of said crossbar members.

5. A support structure according to claim 4 wherein each said crossbar member comprises a horizontally extending upstanding bar having an outwardly angled upper edge.

6. A support structure according to claim 5 wherein said socket members are secured to and between said bars and said outwardly angled upper edges.

7. A support structure according to claim 2 wherein said socket members are of U-shaped configuration, closed on their sides facing outwardly from the ends of said crossbar members and open on their sides facing inwardly from the ends of said crossbar members.

8. A support structure according to claim 7 wherein each said crossbar member comprises a horizontally extending upstanding bar having an outwardly angled upper edge.

9. A support member according to claim 8 wherein said socket members are secured to and between said bars and said outwardly angled upper edges.

10. A support structure according to claim 1 wherein said socket members are of U-shaped configuration, closed on their sides facing outwardly from the ends of said crossbar members and open on their sides facing inwardly from the ends of said crossbar members.

11. A support structure according to claim 10 wherein each said crossbar member comprises a horizontally extending upstanding bar having outwardly angled upper edge.

12. A support member according to claim 11 wherein said socket members are secured to and between said bars and said outwardly angled upper edges.

13. A support structure for a road warning sign comprising a pair of elongated crossbar members having upper and lower edges, means for hingedly connecting said lower edges so that said crossbars are pivotable between a closed position, in which a lower edge of a sheet material road sign is gripped between said crossbar members, and an open position;

two pairs of socket members, one of each of said pairs of socket members attached to each end of one of said crossbar members; a support leg pivotally mounted in each of said socket members, each said leg being pivotable between a ground engaging position in which said leg extends downwardly and outwardly of and substantially normal to a plane containing one of said crossbar members and a folded position in which said leg extends generally parallel with said crossbar member whereby, when said leg members are swung outwardly to said ground engaging position, said legs urge said hingedly connected crossbar members to said closed position, and substantially continuously clamp said lower edge of said sheet material sign between said crossbars under the weight of the support structure and the leverage effect of the outwardly extending ground-engaging legs.

* * * * *

UNITED STATES PATENT AND TRADEMARK OFFICE

CERTIFICATE OF CORRECTION

PATENT NO. : 5,362,020
DATED : November 8, 1994
INVENTOR(S) : Francis C. Brown

It is certified that error appears in the above-indentified patent and that said Letters Patent is hereby corrected as shown below:

On the title page: Item [87] under "PCT Pub. Date: April 30, 1992", insert:

[30] Foreign Application Priority Data

October 17, 1990 [AU] Australia .....PK2818

Signed and Sealed this

Sixteenth Day of May, 1995

*Attest:*

Bruce Lehman

BRUCE LEHMAN

*Attesting Officer*

*Commissioner of Patents and Trademarks*